US006553126B2

(12) United States Patent
Han et al.

(10) Patent No.: US 6,553,126 B2
(45) Date of Patent: Apr. 22, 2003

(54) MICRO SPEAKER

(75) Inventors: Man-Dae Han, Kyungki-do (KR); Bok-Beum Kim, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 09/886,892

(22) Filed: Jun. 21, 2001

(65) Prior Publication Data

US 2002/0071591 A1 Jun. 13, 2002

(30) Foreign Application Priority Data

Dec. 8, 2000 (KR) ..... 2000-74830

(51) Int. Cl.[7] ..... H04R 25/00
(52) U.S. Cl. ..... 381/409; 381/396
(58) Field of Search ..... 381/396, 409, 381/150, 412, 420, 432; 340/388.1, 390.2, 391.1, 384.73, 407.1

(56) References Cited

U.S. PATENT DOCUMENTS 5,838,809 A * 11/1998 Sato et al. ..... 381/409

FOREIGN PATENT DOCUMENTS

JP 2000-224693 8/2000

* cited by examiner

*Primary Examiner*—Sinh Tran
(74) *Attorney, Agent, or Firm*—Renner, Otto, Boisselle & Sklar, LLP

(57) ABSTRACT

A micro speaker is disclosed. An oscillating plate is secured to the bottom of a protecting cover, and a terminal is installed on a side of the protecting cover, the terminal being electrically connected to a voice coil. A magnetic circuit is secured into a recess of a frame, and the protecting cover is attached on the top of the frame. Accordingly, when disassembling the speaker unit, any damage of the oscillating plate can be excluded. Further, when grounding the terminal to a circuit board, the connecting portion of the terminal is prevented from forming a short circuit.

6 Claims, 6 Drawing Sheets

MICRO SPEAKER

FIELD OF THE INVENTION

The present invention relates to a micro speaker. Particularly, the present invention relates to a micro speaker in which when disassembling a protecting cover and a frame from each other, internal components are prevented from being damaged, an unnecessary squandering of resources is avoided, and an occurrence of a short circuit formation is also prevented during the installation of the speaker unit.

BACKGROUND OF THE INVENTION

As shown in FIG. 1, the generally known speaker includes: a magnetic circuit part 1 consisting of a yoke part 1*b,* a magnet 1*a* mounted upon the yoke part 1*b,* and an upper plate 1*d* stacked upon the magnet 1*a*; an oscillating part 2 consisting of a bobbin 2*c* with a voice coil 2*a* wound thereon, an oscillating plate 2*d* and a damper 2*b* coupled to the outside of the bobbin 2*c,* a dust cap 2*e* for preventing a contaminating material from intruding into the bobbin 2*c,* and an edge 2*g* for connecting the oscillating plate 2*d* to a frame 4*a*; and a main body 4 consisting of the frame 4*a* for protecting the magnetic circuit part 1 and the oscillating part 2, and a gasket 4*b* for fixing the oscillating plate 2*d* to the frame 4*a*.

The conventional micro speaker is constituted as shown in FIG. 2.

That is, a magnet 40 and an upper plate 50 are stacked in such a manner that a gap 30 should be formed within a frame 10 which has a magnetic circuit installing recess 20, thereby forming a magnetic circuit 80.

A voice coil 55 is wound on the lower portion of an oscillating plate 60 to be inserted into a gap 30, and the oscillating plate 60 which has a coupling face 60*a* is coupled to the frame 10.

A protecting cover 70 is secured to the top of the frame 10, and a terminal 85 connects the voice coil 55 to the frame 10.

In the above described micro speaker, the magnetic circuit 80 is secured into the frame, that is, into the recessed magnetic circuit securing part 20. Further, the oscillating plate 60 with the coupling face 60*a* is secured to the frame 10 in such a manner that the voice coil 55 can be inserted into the gap 30 which is formed between the magnetic circuit 80 and the frame 10.

The protecting cover 70 is fixed to the top of the frame 10 so as to protect the oscillating plate 60 and the magnetic circuit 80. The voice coil 55 is grounded through the terminal 85 to the circuit board 90.

Under this condition, if electrical signals are supplied through the terminal 85 to the voice coil 55, then the flow of the magnetic fluxes which occurs within the gap 30 causes the electrical signals to be converted to sounds.

However, In this speaker, when the terminal 85 which is connected to the voice coil 55 is connected to the circuit board 90, a short circuit is liable to be formed in the circuit board.

Further, if the magnetic circuit 80 or the oscillating plate 60 is defective, then the oscillating plate 60 and the frame 10 become unseparable from each other, with the result that the whole product has to be replaced, thereby bringing an otherwise unnecessary squandering resources. Further, when fixing the protecting cover, if the spreading of the bonding fluid is not perfectly uniform, then the bonding fluid may flow down to the oscillating plate 60, thereby resulting in a split resonance.

Further, the magnetic circuit 80 which is bonded onto the frame 10, the oscillating plate 60 which is inserted into the gap 30, and the protecting cover 70 are all secured by spreading a bonding fluid and by drying it in a repeated manner. Accordingly, the time for the bonding procedure is extended.

SUMMARY OF THE INVENTION

The present invention is intended to overcome the above described disadvantages of the conventional techniques.

Therefore it is an object of the present invention to provide a micro speaker in which if the magnetic circuit and oscillating plate are defective, then the protecting cover is separated from the frame to replace only the defective element, the connecting portion of the terminal cord is prevented from being contacted to the circuit board so as to prevent the formation of a short circuit, the defective spreading of the bonding fluid is minimized during the spreading of the bonding fluid, and the time required for assembling the magnetic circuit and the oscillating plate is shortened to the minimum.

In achieving the above object, the micro speaker according to the present invention includes: a frame with a yoke integrally formed therein, and with a magnetic circuit securing recess formed therein; a magnetic circuit consisting of a magnet and an upper plate, leaving a gap between the inside wall of the magnetic circuit securing recess and the magnetic circuit; a protecting cover installed on the top of the frame, and having an oscillating plate installing recess, and having a terminal cord securing piece in a projecting form; and an oscillating plate bonded to the oscillating plate securing recess, and having a voice coil on its bottom, the voice coil being connected to the terminal cord.

BRIEF DESCRIPTION OF THE DRAWINGS

The above object and other advantages of the present invention will become more apparent by describing in detail the preferred embodiments of the present invention with reference to the attached drawings, in which.

DESCRIPTION OF THE PREFERRED EMBODIMENTS

The present invention will be described in detail referring to the attached drawings.

Figure 1:
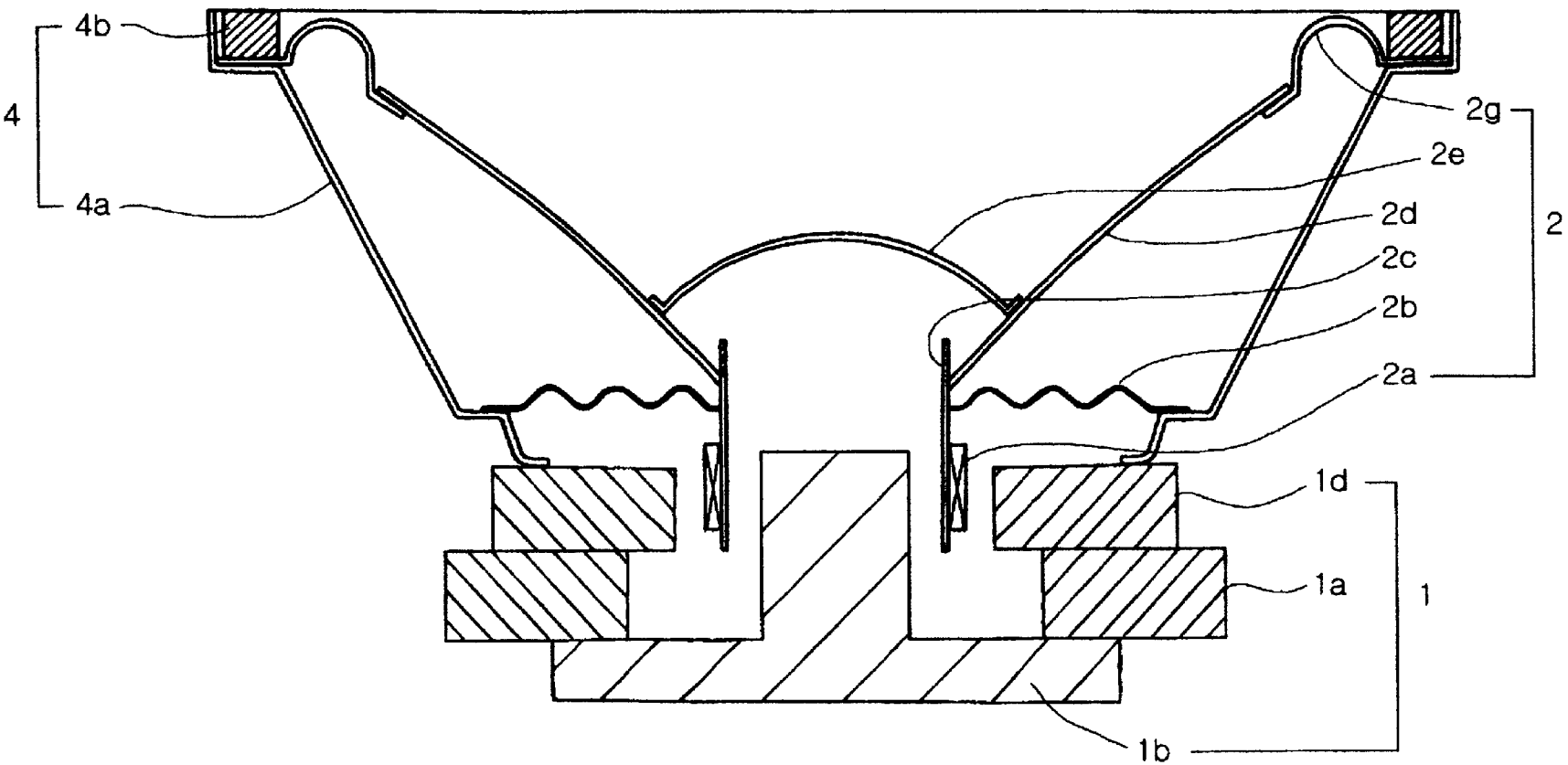
PRIOR ART FIG. 1
FIG. 1 is a sectional view of the general speaker.
Figure 2:
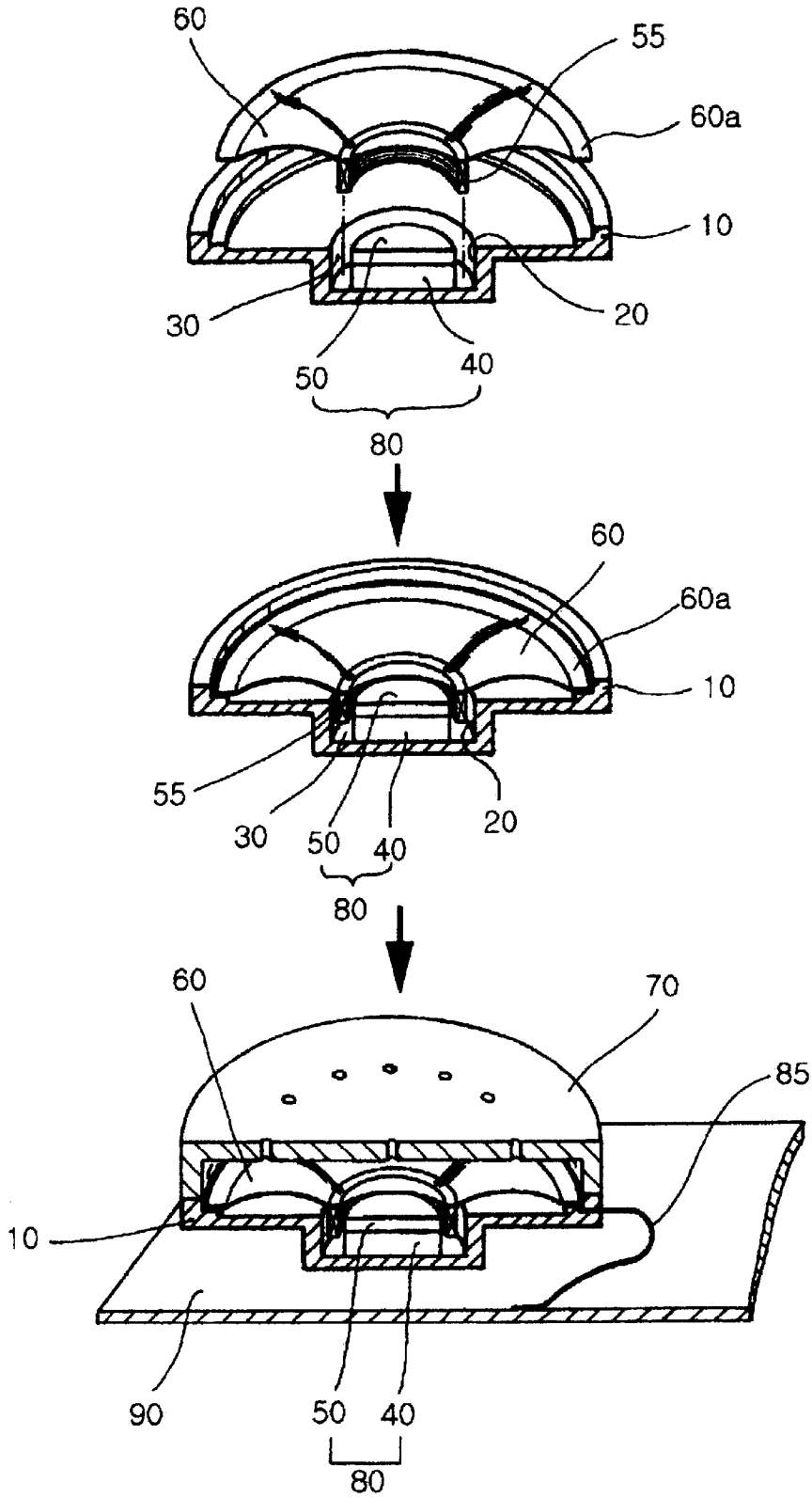
PRIOR ART FIG. 2
FIG. 2 is a schematic view showing the conventional micro speaker.
Figure 3:
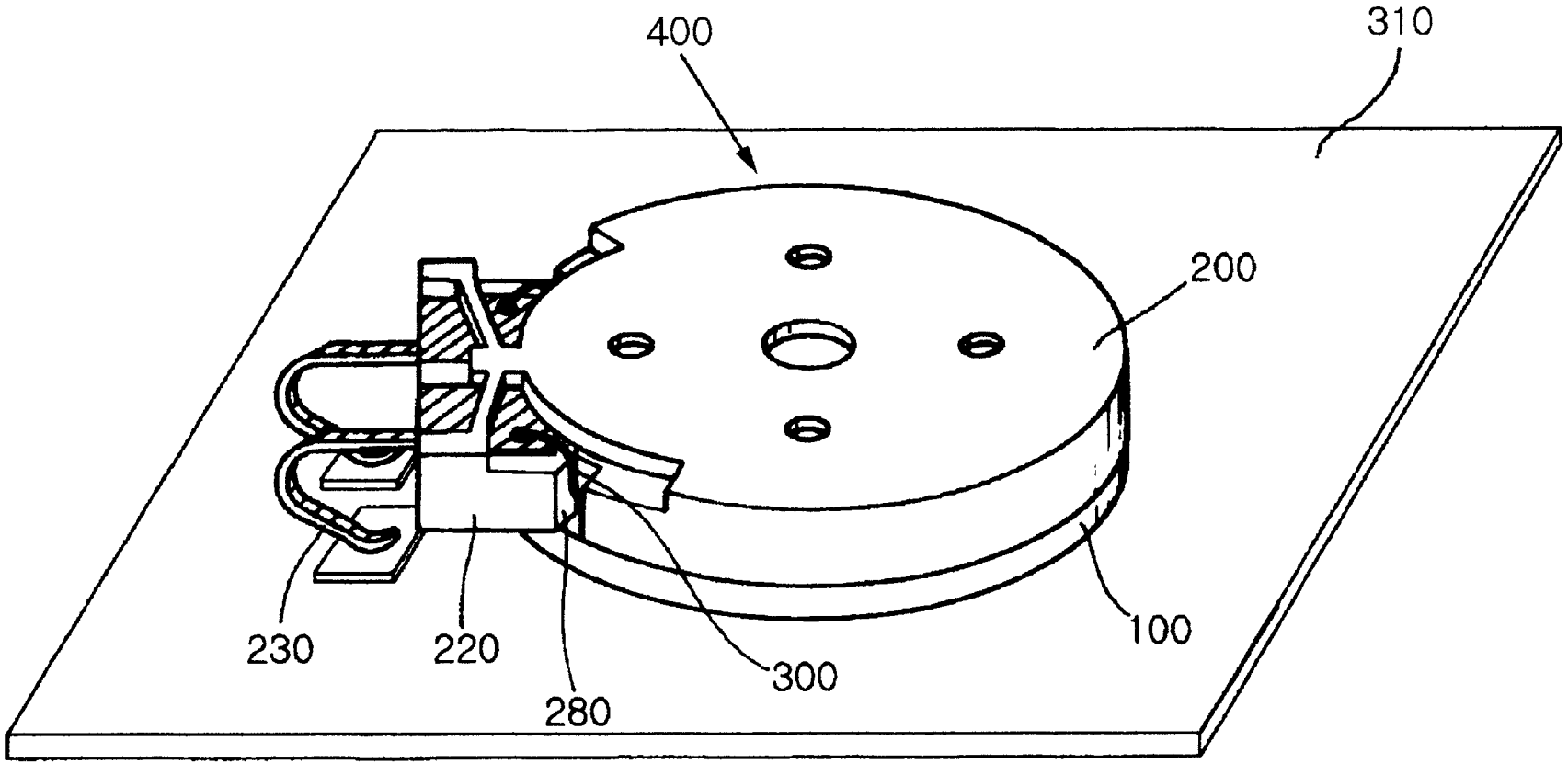
FIG. 3 is a schematic view showing the micro speaker according to the present invention.
Figure 4:
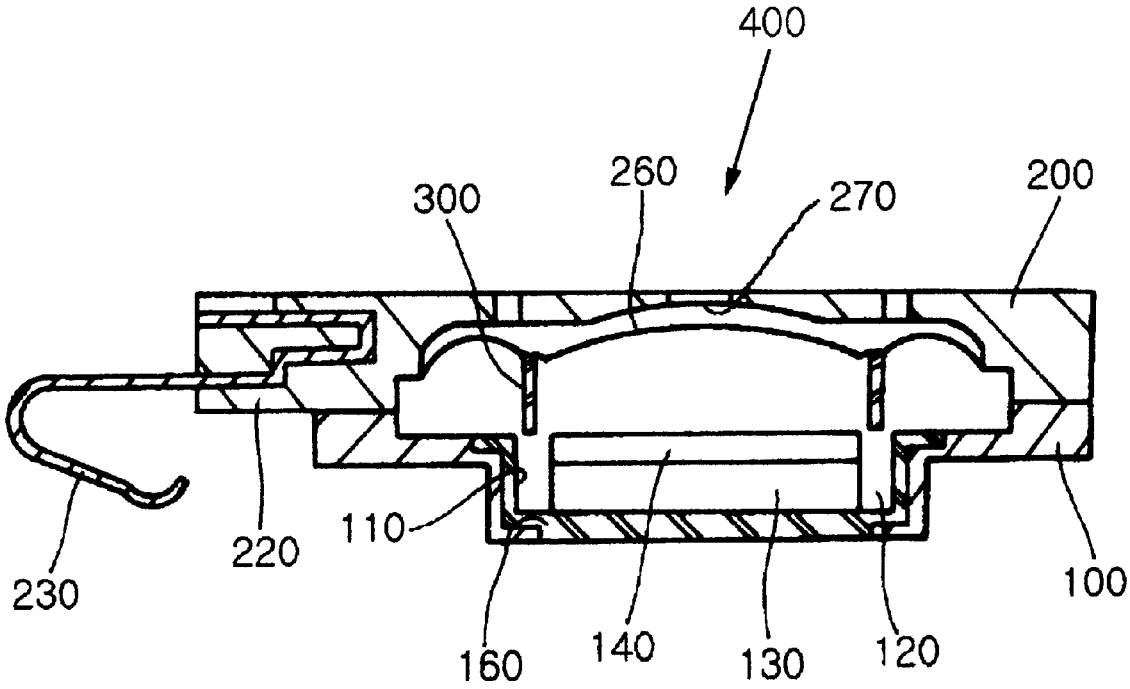
FIG. 4 is a sectional view of the micro speaker according to the present invention.
Figure 5:
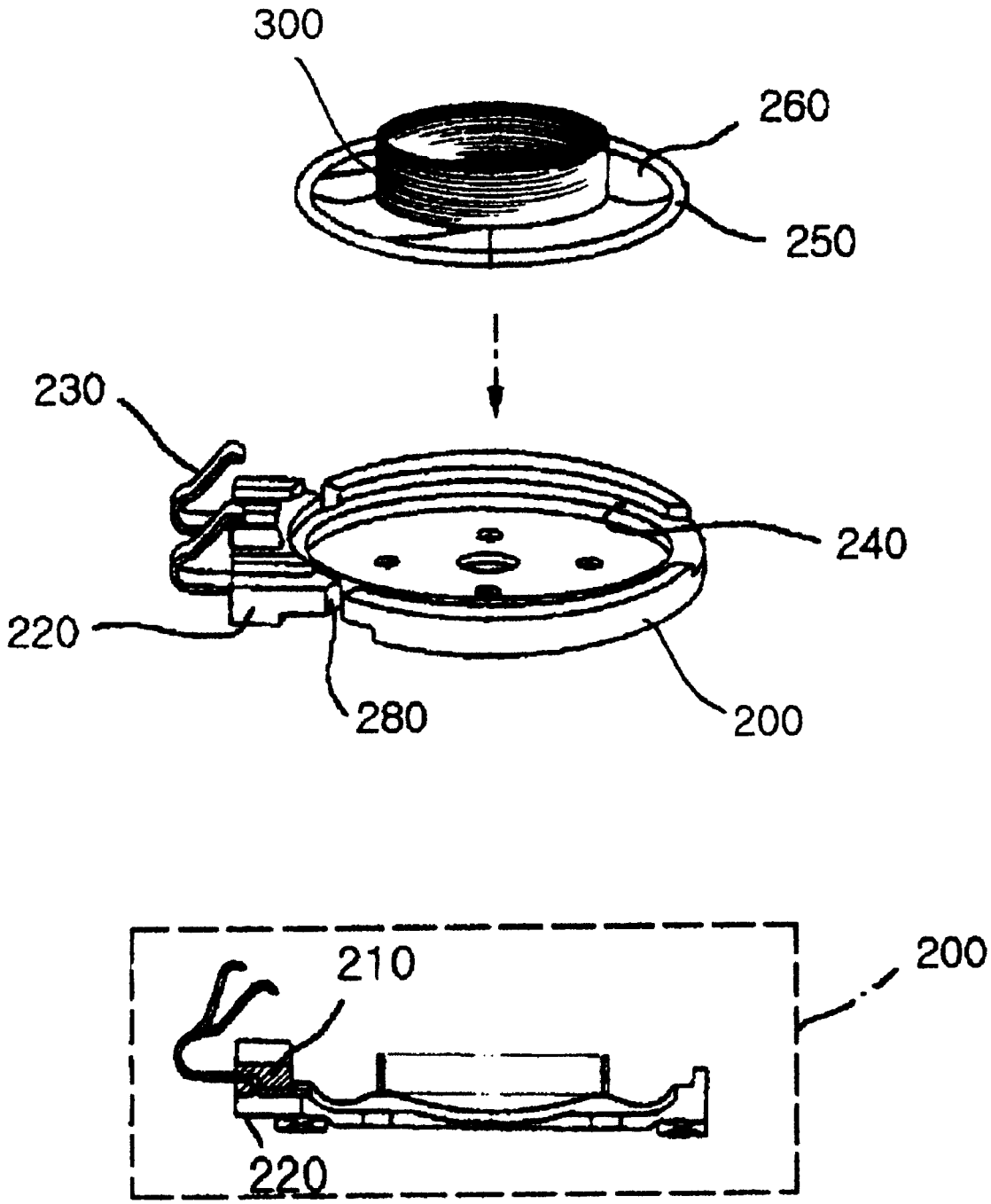
FIG. 5 is an exploded perspective view of the micro speaker according to the present invention.
Figure 6A:
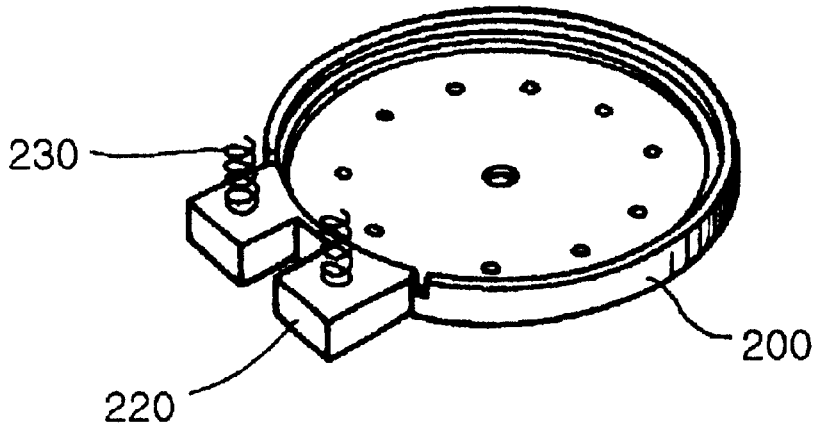
FIGS. 6*a* and 6*b* are schematic views showing the terminal pin in another embodiment of the present invention.
Figure 6B:
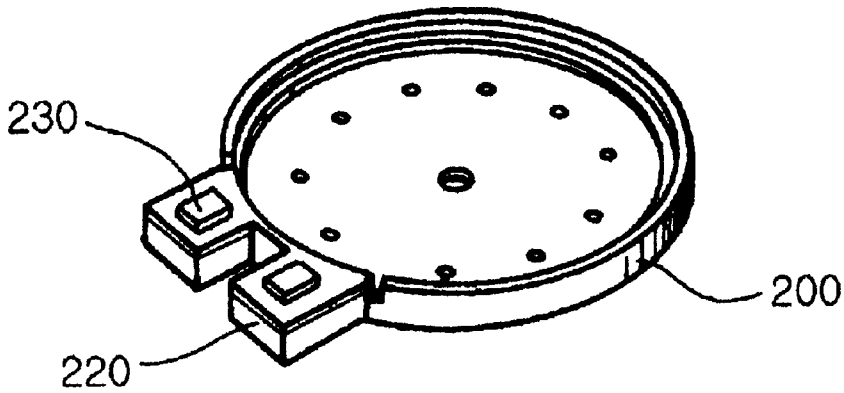

FIG. 3 is a schematic view showing the micro speaker according to the present invention. FIG. 4 is a sectional view of the micro speaker according to the present invention. FIG. 5 is an exploded perspective view of the micro speaker according to the present invention. FIGS. 6*a* and 6*b* are schematic views showing the terminal pin in another embodiment of the present invention. The present invention includes: a frame 100, a magnetic circuit 150, an oscillating plate 260 and a protecting cover 200.

The frame 100 surrounds a yoke 160 made of a conductive material, which has a magnetic circuit securing recess 110. Further, the frame 100 is molded by a plastic injection molding process.

The magnetic circuit 150 which is secured in the magnetic circuit securing recess 110 consists of a magnet 130 and an upper plate 140 stacked together, with a gap 120 being left between the wall of the magnetic circuit securing recess 110 and the magnetic circuit 150.

The protecting cover 200 which is secured on the top of the frame 100 has an oscillating plate securing recess 270, so that the oscillating plate 260 can be installed in the recess 270. Further, a terminal securing piece 220 projects from the protecting cover 200, so that a terminal 230 connected to a voice coil 300 can be secured to the terminal securing piece 220.

Further, the terminal securing piece 220 has a terminal securing hole 210 for securing the terminal 230 which is unitizingly secured in the protecting cover 200.

Further, the terminal 230 is unitizingly secured to the protecting cover 200 during the injection-molding of the frame 100.

Further, a pair of voice coil supporting slots 280 are formed at both sides of the terminal securing piece 220 of the protecting cover 200.

The oscillating plate 260 which is secured to the inside of the protecting cover 200 has a voice coil 300 which protrudes therefrom. The voice coil 300 is coated with an insulating resin, and one end of the voice coil is welded to the terminal 230.

Further, the oscillating plate 260 has a flat contact face 250, and the protecting cover 200 has a contact step 240, so that the contact face can be coupled to the contact step 240.

Alternatively the terminal 230 may consist of a coil spring and a circuit board contact.

Reference code 310 indicates a circuit board to which the terminal 230 is grounded. Reference code 400 indicates a speaker unit.

Now the present invention constituted as above will be described as to its action and effects.

As shown in FIGS. 3 to 6, the frame 100 is formed by a plastic insert injection molding in such a manner that the frame 100 should surround the yoke 160. The magnetic circuit 150 is installed within the magnetic circuit securing recess 110 in such a manner that a gap 120 should be left between the wall of the magnetic circuit securing recess 110 and the magnetic circuit 150.

The magnetic circuit 150 consists of a magnet 130 and an upper plate 140 stacked together by using a bonding material (not illustrated), and the magnetic circuit 150 is installed within the magnetic circuit securing recess 110.

Further, the voice coil 300 which protrudes down from the oscillating plate 260 is inserted into the gap 120 which is formed between the magnetic circuit 150 and the magnetic circuit securing recess 110. That is, the voice coil 300 protrudes down from the oscillating plate 260 which is secured to the bottom of the protecting cover 200.

Thus, if the protecting cover 200 is fitted to the frame 100, then the voice coil 300 of the oscillating plate 260 which is secured to the bottom of the protecting cover 200 is inserted into the gap 120.

Thus the voice coil 300 is connected to the terminal 230 which is secured to the protecting cover 200, and if the terminal 230 is grounded to a circuit board 310, then electrical signals are supplied to the voice coil 300, with the result that the oscillating plate 260 is activated.

Under this condition, the connecting portion (not illustrated) which connects by a welding the terminal 230 to the voice coil 300 is disposed as remote as possible from the circuit board to which the terminal 230 is grounded. In this manner, the connecting portion of the speaker unit 400 is prevented from being grounded to the circuit board 310, thereby preventing the formation of any short circuit.

In an alternative method, the process step of bonding the magnetic circuit 150 to the frame 100 is executed separately from the process step of bonding the oscillating plate 260 to the protecting cover 200. And then the protecting cover 200 is attached to the frame 100. In this manner, the time for forming the speaker unit 400 can be shortened to one half.

Further, the flat contact face 250 of the circumference of the oscillating plate 260 is bonded to the contact step 240 of the protecting cover 200, and therefore, a squandering of the bonding material can be prevented.

Under this condition, the both ends of the voice coil 300 of the oscillating plate 260 are led to the outside after passing through the pair of the voice coil supporting slots 280 respectively.

Further, the voice coil 300 which is led to the outside after passing through the pair of the voice coil supporting slots 280 is welded to the terminal 230 which is secured to the terminal securing piece 220.

The terminal cord securing piece 220 which has the terminal securing hole 210 is formed integrally with the protecting cover 200. Thus the terminal 230 is inserted into the terminal cord inserting hole 210, and is fixed by using a bonding material.

The both ends of the voice coil 300 are led in an easy manner through the voice coil supporting slots 280 which are formed at both sides of the terminal cord securing piece 220. Thus the drawn-out voice coil 300 is connected to the terminal cord 230.

In the above described structure, when replacing the oscillating plate 260 or the magnetic circuit 150 due to a generated defect, the protecting cover 200 can be detached in an easy manner without causing any damage. Thus the oscillating plate 260 and the magnetic circuit 150 can be easily replaced, with the result that any squandering of resources can be prevented.

Further, the protecting cover 200 on which the oscillating plate 260 is secured is attached onto the top of the frame 100. Therefore, when bonding the protecting cover 200 onto the frame 100, the bonding material is prevented from flowing down, so that any distortion of the oscillating plate 260 can be prevented.

Further, the terminal 230 is formed in an integral form when fabricating the terminal securing piece 220. Or the terminal 230 consists of a coil spring and a circuit board contact which is bonded to the terminal securing piece 220.

In the speaker unit 400, the terminal 230 may be arbitrarily manipulated under the encountered circumstance.

Or the terminal 230 which is secured to the terminal securing piece 220 may be formed integrally with the yoke 160 when fabricating the frame 100, so that the securing of the terminal 230 may be easier.

According to the present invention as described above, the oscillating plate is secured to the protecting cover, and then, the terminal is electrically connected to the oscillating plate. Then the protecting cover is attached onto the frame in which the magnetic circuit has been secured. In this manner, any occurrence of defect in the magnetic circuit and the oscillating plate can be speedily responded.

Further, the connecting portion of the terminal which supplies electrical signals to the voice coil is disposed as remotely as possible when the terminal is grounded to the circuit board, thereby preventing the occurrence of any short circuit.

Further, the protecting cover on which the oscillating plate is secured is attached onto the top of the frame, and therefore, the bonding material is prevented from flowing down, so that any distortion of the oscillating plate can be prevented.

Further, the process step of bonding the oscillating plate to the protecting cover is carried out separately from the process step of bonding the magnetic circuit to the frame, and therefore, the time for assembling the speaker unit can be shorted to one half.

In the above, the present invention was described based on the specific preferred embodiments and the attached drawings, but it should be apparent to those ordinarily skilled in the that various changes and modifications can be added without departing from the spirit and scope of the present invention which will be defined in the appended claims.

What is claimed is:

1. A micro speaker comprising:

a frame with a yoke integrally formed therein, and with a magnetic circuit securing recess formed therein;

a magnetic circuit consisting of a magnet and an upper plate, the magnetic circuit being disposed within the magnetic circuit securing recess with a gap between an inside wall of the magnetic circuit securing recess and the magnetic circuit;

a protecting cover installed on a top of the frame, and having an oscillating plate installing recess, and having a terminal securing piece in a projecting form;

an oscillating plate bonded to the oscillating plate securing recess, and having a voice coil on its bottom, the voice coil being connected to a terminal secured to the terminal securing piece; and a pair of voice coil supporting slots formed at both sides of the terminal securing piece, through which ends of the voice coil pass for connection to the terminal.

2. The micro speaker as claimed in claim 1, further comprising: a flat contact face formed on a circumference of the oscillating plate; and a contact step formed on the protecting cover, whereby the contact face and the contact step are coupled together.

3. The micro speaker as claimed in claim 1, wherein the terminal is formed integrally with the terminal securing piece and wherein the terminal is secured within the terminal securing piece.

4. The micro speaker as claimed in claim 1, wherein the terminal is inserted into a terminal securing hole of the terminal securing piece, and is secured by using a bonding material.

5. The micro speaker as claimed in claim 1, wherein the terminal consists of any one of a flat spring, a coil spring and a contact circuit board.

6. The micro speaker as claimed in claim 1, wherein the frame is formed by a plastic insert injection molding so as to surround the yoke.

* * * * *